United States Patent [19]

Okutsu et al.

[11] 4,043,817

[45] Aug. 23, 1977

[54] METHOD OF FORMING PHOTOGRAPHIC IMAGES FOR LITHOGRAPHIC USE

[75] Inventors: Eiichi Okutsu; Katsumi Hayashi; Shigenori Moriuchi; Takeo Sakai, all of Minami-ashigara, Japan

[73] Assignee: Fuji Photo Film Co., Ltd., Minami-ashigara, Japan

[21] Appl. No.: 629,826

[22] Filed: Nov. 7, 1975

[30] Foreign Application Priority Data

Nov. 7, 1974 Japan ..... 49-128769

[51] Int. Cl.[2] ..... E03C 5/30; E03C 1/76

[52] U.S. Cl. ..... 96/66 R; 96/66.3; 96/68

[58] Field of Search ..... 96/66 R, 66.3, 114.6, 96/95, 68

[56] References Cited

U.S. PATENT DOCUMENTS

| | | | |
|---|---|---|---|
| 3,394,005 | 7/1968 | Blake | 96/67 |
| 3,708,303 | 1/1973 | Salesin | 96/95 |
| 3,782,945 | 1/1974 | Shimamura et al. | 96/66.3 |
| 3,785,822 | 1/1974 | Overman | 96/66.3 |
| 3,832,180 | 8/1974 | Douglas | 96/95 |

*Primary Examiner*—Mary F. Kelley

*Attorney, Agent, or Firm*—Sughrue, Rothwell, Mion, Zinn and Macpeak

[57] ABSTRACT

A continuous method for producing halftone images comprising:

1. image-wise exposing a lith-type silver halide photographic material comprising a silver halide emulsion with not less than about 85 mol% silver chloride and not more than about 8 mol% of silver iodide and containing at least one organic silver complex compound which is substantially insoluble in water in contiguous relationship with a photosensitive silver halide emulsion which contains not less than 60 mol% silver chloride and which is chemically and spectrally sensitized; and 2. developing the photographic material in a continuous fashion with a developer containing hydroquinone and a carbonyl-bisulfite adduct in the presence of a polyalkylene oxide of a molecular weight not less than 1000.

6 Claims, 1 Drawing Figure

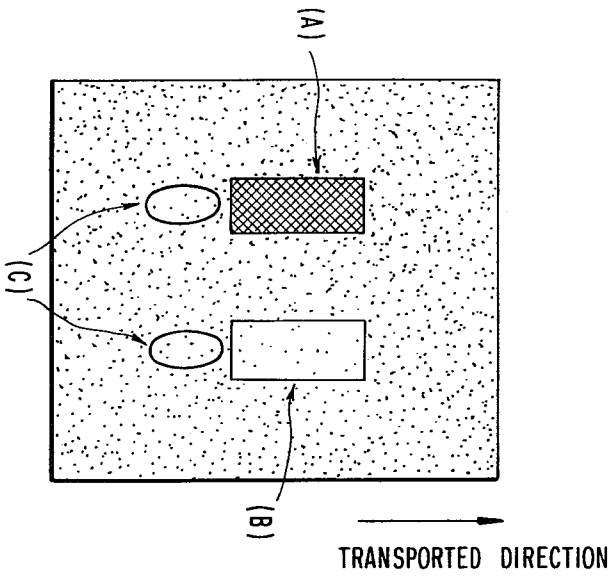
(A)
(B)
(C)
TRANSPORTED DIRECTION

METHOD OF FORMING PHOTOGRAPHIC IMAGES FOR LITHOGRAPHIC USE

BACKGROUND OF THE INVENTION

1. Field of the Invention

This invention relates to silver halide photographic materials, more particularly, to improved lith-type photographic materials as well as a development method therefor.

The present invention relates to development methods for exposed, high contrast silver halide photographic materials by the use of an automatic continuous processing apparatus, and the improvements realized by the present invention are primarily increased image contrast and a marked reduction or perfect removal of drag streaks in the resulting developed images.

2. Description of the Prior Art

So-called "lith" type photographic films which are used for the preparation of a printing master usually utilize silver halide photographic emulsions of an extremely contrasty nature. In lith-type photographic materials, the exposed areas exhibit an auto-catalytic activity during development, thus forming an image of extremely high contrast. Developer solutions used for such high contrast photographic films are quite different from those used for ordinary black and white photographic films. Usually, such a high contrast film is quite sensitive to the reaction products in the developer solution, e.g., when such a film is subjected to continuous development (continuous film transport conditions), local shortages or starvation of the principal reducing agent or diffusion of the reaction products caused by development takes place at the areas which are adjacent areas where development (reduction of silver halide) proceeds vigorously.

Hence, when such a film is processed with an automatic processor through which the film is continuously transported (as disclosed in U.S. Pat. Nos. 3,025,779, 3,545,971, 3,573,914, 3,615,524, 3,625,689, 3,678,842, 3,678,843, 3,724,355, etc., hereby incorporated by reference) an image defect tends to appear in the resulting image which has been called "drag streaks" or "directional drag streaks" in film halftone areas.

Drag streaks also appear in high density regions, which, for example, in the case of halftone image reproduction have a dot area of from 50 to 90%, adjacent low density regions, which, for example, have a dot area of 20% or lower.

The formation of such drag streaks in the latter case can be attributed to the fact that the developer solution "dragged into" a high density area from a low density area includes a higher concentration of the principal reducing agent and a lower concentration of the reaction or developer exhaustion products (mainly bromide ion) than the average, and development thus proceeds in an uneven fashion. Further, based on the same mechanism as in drag streak formation, other defects, i.e., dot distortion and dot size variation, are observed in a halftone image in a high contrast film processed with a continuous transportation type automatic processor. These defects are inherent to processing with such an automatic processor, and are not observed when the film is processed in a vat.

As has been hitherto described, though considered to be peculiar to high contrast silver halide photographic materials, drag streak formation is quite similar to the edge effect which is generally observed in ordinary silver halide photographic materials (see *The Theory of the Photographic Process* by Mees at page 1031, the revised edition). Drag streaks can be regarded as an intensified edge effect, synergistically enhanced by the high contrast of the lith film when processed in a continuous transporting automatic processor. Therefore, in order to reduce or minimize drag streaks of high contrast film processed in a continuous transporting automatic processor, one must take care to:

i. utilize a developer together with a photographic film whose sensitivity does not highly depend on developer fatigue, and ii. remove reaction product formed by development from the developing system. These conditions can also be deduced from the description in *The Theory of the Photographic Process* by Mees on 1031, the revised edition.

The elimination or reduction of drag streaks and of dot distortion would be a substantial contribution to the graphic arts.

One technique effective to reduce drag streaks is described in U.S. Pat. No. 3,625,689, according to which drag streaks are effectively prevented in a photographic member having a silver halide photosensitive emulsion comprising at least 85 mol% silver chloride and from 0.1 to 5 mol% silver iodide processed with an automatic processor charged with a developing solution containing a principal reducing agent and a condensation product of a carbonyl bisulfite with an amine. However, the above mentioned photosensitive silver halide emulsion is, according to disclosure of the patent, advantageously processed only with a very restricted sort of developer containing a carbonyl bisulfite/amine condensate.

Another technique is disclosed in U.S. Pat. No. 3,615,524, which, however, utilizes a cadmium compound added to the silver halide photographic material. The cadmium compound diffuses into the developer as well as into the fixer employed when processing such a material. Since cadmium is quite dangerous and is a source of environmental pollution, there is an urgent need to develop a method for drag streak reduction without the use of a cadmium compound.

SUMMARY OF THE INVENTION

The present invention is based on the fact that drag streaks can be markedly reduced, which is a characteristic of processing in a continuous transporting automatic processor, when a silver halide emulsion comprising at least one organic silver complex compound which is substantially insoluble in water (maximum solubility is not more than $10^{-4}$ mol per liter) and which contains not less than 85 mol% silver chloride and not more than 8 mol% silver iodide is added to a spectrally and chemically sensitized lith-type silver halide photographic emulsion layer, or to a layer adjacent thereto.

One prominent feature of the present invention is that the method of the present invention is effective for processing with various lith developers containing hydroquinone and a bisulfite adduct of a carbonyl compound, which is not the case for the method disclosed in U.S. Pat. No. 3,625,689.

Another advantage is that emulsion formulations are free of any heavily polluting compounds, in contrast to the technique of U.S. Pat. No. 3,615,524.

Further, as is well known in the art, photosensitive materials employing a silver halide emulsion mainly comprising silver chloride exhibit characteristically high contrast of halftone images, expressed by the dot area ratio. Accordingly, the method disclosed in U.S. Pat. No. 3,625,689 suffers from the difficulty that a photosensitive material is formulated having a low contrast of halftone images, since the method is based on the use of a silver halide emulsion containing more than 85 mol% of silver chloride. As a result, the halftone contrast is undesirably restricted to a certain narrow range.

On the other hand, the present invention employs as the primary emulsion a typical, lith-type, spectrally sensitized silver halide emulsion containing not less than 60 mol% silver chloride, which permits a wide selection of halftone contrast characteristics.

BRIEF DESCRIPTION OF THE DRAWING

The drawing illustrates the means for the evaluation of drag streaks, in which areas A and B have a dot area of 95 and 5%, respectively while the remaining background has a dot area of 50%. The film sample exposed through this chart is processed by an automatic processor, through which it is transported in the direction shown by the arrow.

DETAILED DESCRIPTION OF THE INVENTION

Lith-type developers which give high contrast image are widely used to develop photographic films for the reproduction of lithographic dot images. The lith-type developer used in the present invention basically comprises an o- or p-dihydroxybenzene, an alkaline agent, a small amount of free sulfite ion and a sulfite ion buffer.

The o- or p-dihydroxybenzene which is the developing agent can be selected from those well known in the art considering the requirements involved. Representative compounds include hydroquinone, chlorohydroquinone, bromohydroquinone, isopropylhydroquinone, toluhydroquinone, methylhydroquinone, 2,3-dichlorohydroquinone, 2,5-dimethylhydroquinone, etc. Among these, hydroquinone is most preferred. The developer can contain one or more of these compounds as a primary reducing agent. The concentration of the developing agent is from about 5 to about 50 g, more preferably from 10 to 30 g per liter of developer.

The carbonyl bisulfite adduct compound as a sulfite ion buffer is incorporated at a concentration level which maintains the sulfite ion concentration low. Suitable compounds include aldehyde-alkali bisulfite adducts such as a formaldehyde-sodium bisulfite adduct, ketone-alkali bisulfite adducts such as an acetone-sodium bisulfite adduct, carbonyl bisulfite-amine condensates as are set forth in U.S. Pat. No. 3,573,914, etc. The sulfite ion buffer is not restricted to those cited above; alternatively, one may incorporate, for example, each component of these adducts or condensates in the developer. The sulfite ion buffer may be added in an amount of from about 13 to about 130 g, more preferably from 30 to 75 g, per liter of developer.

Typical alkali materials include sodium carbonate, potassium carbonate, sodium hydroxide, potassium hydroxide, trisodium phosphate or sodium metaborate, usually added in an amount to provide a developer pH of 9 to 12.

An important feature of lith developer is to maintain a low concentration of free sulfite ion, as has been pointed out, with the aid of a sulfite ion buffer. Since a sulfite ion buffer per se provides an insufficient amount of free sulfite ion, so an alkali metal sulfite (e.g., sodium sulfite or potassium sulfite) in an amount of up to 10 g (preferably only up to 5 g) per liter of developer is added to maintain a suitable concentration of free sulfite ion.

A lith type developer for use in the present invention can contain, in addition to the ingredients set out above, a pH buffer such as a water soluble acid, alkali or salt, and a development controlling agent such as an alkali halide, depending on the requirements involved. The developer can further contain an organic anti-foggant such as benzotriazole, 1-phenyl-5-mercaptotetrazole, etc., a polyalkylene oxide, an amine compound, and an organic solvent such as triethylene glycol, dimethylformamide, methyl alcohol, Cellosolve or those set forth in U.S. Pat. No. 3,552,969, etc. The amount of such an organic solvent is preferably from 0 to about 300 ml per liter of developer.

One can use in the present invention as the principal emulsion lith-type silver halide photographic emulsions as are conventionally used in the graphic field including silver chloride emulsions, silver chlorobromide emulsions and silver chlorobromoiodide emulsion. In particular, silver chlorobromide or chlorobromoiodide emulsions containing not less than 60 mol% silver chloride are preferred.

On the other hand, one can employ, as a secondary silver halide emulsion to be blended with the principal emulsion or to form layer adjacent thereto for use the present invention, an emulsion containing silver chloride, silver chlorobromide or silver chloroiodobromide. Those emulsions containing not less than about 85 mol% silver chloride and not more than about 8 mol% silver iodide are preferred, while most preferred are those comprising pure silver chloride, silver chlorobromide containing not less than 85 mol% silver chloride, or silver chloroiodide containing not less than 85 mol% silver chloride. These emulsions may be chemically sensitized and may contain a spectral sensitizer, a hardener, a surface active agent and a storage stabilizer; the secondary emulsions have a photographic speed which is generally about 1/5 to about 1/100 that of the principal emulsion. Most preferably, the secondary emulsion has a photographic speed of 1/10 to 1/50 that of the principal emulsion.

The photographic speed mentioned above is defined by the reciprocal of the exposure required to obtain a predetermined optical density above fog (i.e., 1.50 above fog density) using identical development methods.

The photographic speed thus defined includes both the speed with which the silver halide reacts to light and the rate at which the development proceeds during the initial stage of development.

It should be pointed out that the present method is quite different from the method set forth in Japanese Patent Application (OPI) No. 10727/74, which involves the use of a lith-type silver halide photographic material comprising silver halide crystals containing not less than 80 mol% silver chloride which is not chemically sensitized and which is substantially insensitive to light. A first difference is that the present invention relates to reducing drag streaks which characteristically appear in a lith-type photographic film processed with a continuous transport automatic processor. Secondly, by the addition of a substantially light-insensitive silver halide emulsion to a principal lith-type photosensitive one cannot substantially prevent drag streaks from forming during such automatic processing. On the other hand, the present invention can employ a lith-type silver halide photographic material which comprises a silver halide emulsion containing at least one organic silver complex compound which is substantially insoluble in water, comprising not less than about 85 mol% silver chloride and up to about 8 mol% silver iodide, but this emulsion is blended with a principal lith-type photosensitive silver halide emulsion or constitutes an auxiliary layer for such a principal emulsion layer. The use of such a secondary emulsion in combination with the principal photosensitive silver halide emulsion is exceptionally effective for reducing drag streaks.

The ratio of the silver halide emulsion to be blended or to constitute an auxiliary layer to the principal emulsion which include not less than 60 mol% of silver chloride is preferably between 5 and 100 mol%.

Silver halide emulsions for use in the present invention include those of any crystal habit, e.g., cubic, or octahedral crystals, mixtures thereof and those of other crystalline forms.

These silver halide crystals can be prepared in accordance with the conventional methods well known in the art, which include a single jet method, double jet method, controlled double jet method, etc., and neutral, acid and ammonium processes.

The silver halide particles thus prepared may be monodispersed or polydispersed as disclosed in British Pat. Nos. 1,186,711 – 3,186,717, 1,186,719, 1,186,721, etc. They preferably have a grain size of 0.01 to 1.0 $\mu$, preferably 0.02 to 0.8 $\mu$. The amount of binder is generally about 10 to about 100 g per 100 g of silver nitrate ($AgNO_3$) in the halide formation, though this is not mandatory by any means.

Organic silver complex compounds which are substantially insoluble in water for use in the present invention have a smaller solubility product constant in water than that of silver chloride so that the concentration of dissociated silver ion is less than that of silver chloride. Preferred examples of such materials include silver complex salts of compounds having an imino or mercapto group (e.g., the silver complex of benzimidazole, 2-mercaptobenzothiazole, 2-mercaptobenzimidazole, 1-phenyl-5-mercaptotetrazole, etc.) or silver complex salts of azaindolidines (e.g., the silver complex of 7-hydroxy-2,3,4-triazaindolidine, 5-methyl-7-hydroxy-2,3,4-triazaindolidine, 5-butyl-7-hydroxy-2,3,4-triazaindolidine, etc.), etc.

These compounds can be added in the form of a solution which consists of a water-miscible organic solvent having no photographic effect (e.g., methanol, acetone, etc.) to the emulsion for blending therewith or for an auxiliary layer, or can be formed directly in the emulsion by adding an organic complexing compound and a silver salt thereto.

In the case of a compond having a smaller solubility product than that of silver chloride, one can add a suitable organic compound to a silver choride emulsion or to a silver chlorobromide emulsion with a high content of silver chloride (not less than 80 mol% of silver chloride), whereby the corresponding substantially insoluble organic silver compound forms.

The addition level of such an organic substantially insoluble silver complex to a primary and/or secondary emulsion is preferably from about 0.1 to about 10 g of the complex per mol of silver halide in the emulsion. The ratio of secondary emulsion to primary emulsion is most preferably 5 to 70 wt% of secondary emulsion based on 100 wt% of primary emulsion. It is further very highly preferred that the thickness of the primary emulsion layer be about 1 to 10 $\mu$, and that of the secondary emulsion layer be about 1 to 5 $\mu$, with the ratio of the secondary emulsion layer thickness to the primary emulsion layer thickness being 0.05 to 100% thereof.

The principal and the auxiliary emulsions for use in the present invention may contain as a dispersant one or more conventional hydrophilic colloid materials such as gelatin, gelatin derivatives such as phthalated gelatin, malonated gelatin, etc., cellulose derivatives such as collodion, hydroxyethyl cellulose, carboxymethyl cellulose, etc., soluble starches such as dextrin, alkali starch, etc., and other hydrophilic polymeric materials such as polyvinyl alcohol, polyvinyl pyrrolidone, polyacrylamide, polystyrene sulfonic acid, etc., no criticality is attached to the binder.

The silver halide emulsions used in the present invention may also contain a hydrophobic polymeric material such as a polyalkyl acrylate, polyalkyl methacrylate, polyacrylic acid, or copolymers of alkyl acrylate and acrylic acid, and a plasticizer for gelatin such as glycerol or trimethanolpropane, etc. Such emulsions can be sensitized in a variety of ways when they are prepared and coated. For example, they can be chemically sensitized with sodium thiosulfate, an alkyl thiourea, etc., or with a complex salt of aurous ion with thiocyanic acid, or with combinations of such sensitizers. Further a heavy metal compound such as palladium, platinum, iridium, rhodium, cadmium, etc., can be added thereto, if desired. The silver halide emulsions used in the present invention can be ortho- or panchromatically spectrally sensitized by the addition of a spectral sensitizing dye thereto such as a cyanine dye, merocyanine dye, etc.

Further, the silver halide emulsions used in the present invention can contain a dot quality improving agent such as combinations of a polyalkylene oxide and an amine compound (see Japanese Patent Publication No. 14402/64, German Patent (OLS) No. 1,932,882, and Japanese Patent Publication No. 23466/65), sodium benzene thiosulfate, benzotriazole, and 1,3,3a,7-tetrazaindene derivatives (see Japanese Patent Publications Nos. 15715/64 and 17903/65). As such polyalkylene oxides, those with molecular weights of not less than 1,000 are used (such materials are disclosed in U.S. Pat. Nos. 3,294,540 and 3,516,830). The emulsions for use in the present invention may be hardened with a suitable hardening agent such as formaldehyde, dimethylolurea, 2,4-dichloro-6-hydroxy-1,3,5-triazine (see U.S. Pat. No. 3,325,287), mucochloric acid, etc., can have added a coating additive such as saponin and other surfactants, and development controlling agents such as 3-pyrazolidone derivatives, pyrazolone derivatives, etc. The emulsions may also include a development accelerator, such as a quaternary ammonium salt, or a cationic surface active agent.

The support material used for the photosensitive members of the present invention is conventional and, though not limited, includes cellulose acetate, polystyrene, polycarbonate, polyethylene terephthalate, paper, paper laminated with a polymer film, etc.

The silver halide emulsion layer and other photographic layers, e.g., protective layer, can be coated by any method known in the art including dip, air knife, curtain coating, and extruding coating using a hopper. If desired, two or more coatings can be simultaneously formed. In the following, some practical examples of the present invention will be described to further explain the advantages thereof.

EXAMPLE 1

A fine grain silver chloroiodobromide-gelatin emulsion, the halogen composition being 70 mol% chloride, 29 mol% bromide and 1 mol% iodide, was chemically sensitized by a sulfur compound (sodium thiosulfate ($10^{-5}$ mol/mol Ag) and a gold compound (sodium chloroaurate ($10^{-5}$ mol/mol Ag)) in combination. It was then spectrally sensitized with 3-carboxymethyl-5-[2-(3-ethylthiazolinylidene)ethylidene]rhodanine ($2 \times 10^{-4}$ mol/mol Ag), and then a development accelerator added comprising a polyoxyethylene nonylphenyl ether containing 50 units of ethylene oxide ($5 \times 10^{-4}$ mol; m.w. = 2600) and a compound represented by

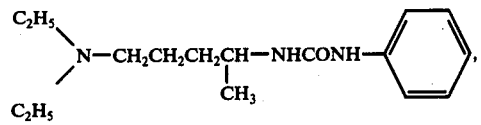

followed by the addition of mucochloric acid (hardener; 0.03 g/g gelatin) and a polybutyl methacrylate latex to form Emulsion A (silver halide grain size: 0.3 μ).

Separately, 1,000 ml of a 1 molar $AgNO_3$ solution and 1,000 ml of a 1.15 molar NaCl solution were simultaneously added to 500 ml of water (in which 15 g of gelatin had been dissolved) at 55° C over a 30 minute period. After 80 g of gelatin was further added thereto at 55° C, the resulting gel was washed with water in a conventional manner, and divided into two fractions. One fraction was chemically sensitized with a sulfur compound (sodium thiosulfate ($10^{-5}$ mol/mol Ag)) and a gold compound (sodium chloroaurate ($10^{-5}$ mol/mol Ag)) so as to have a photographic speed 1/20 that of Emulsion A. This fraction was designated Emulsion B (silver halide grain size 0.25 μ). The other fraction was not subjected to chemical sensitization and was designated Emulsion C (silver halide grain size 0.25 μ). The photographic speed of Emulsion C was less than 1/100 that of Emulsion A. The wt. ratio of silver halide:gelatin in all emulsions was 2.0.

Principal emulsion A was blended with either Emulsion B or Emulsion C with or without the addition of either the silver salt of 5-methyl-7-hydroxy-2,3,4-triazaindolidine in an amount of 1.5 g/mol of silver halide in the emulsion or the silver salt of 1-phenyl-5-mercaptotetrazole in an amount of 1.0 g/mol of silver halide in the emulsion in the ratio shown in Table 1, and each blended emulsion was coated on a polyethylene terephthalate film in such a manner that the coated amount of silver corresponded to 6.0 g/m² in the emulsion layer.

Each sample was exposed to halftone screen image by the use of an incandescent lamp (tungsten: 2854° K; 15 sec.) and 150 line magenta contact screen; the image, as is illustrated in FIG. 1, comprised two rectangular areas, one (A) having a dot area of 95%, and the other (B) 5%, surrounded by a 50% dot area background. The exposed sample was processed with an automatic lithfilm processor "FG-14L" produced by Fuji Photo Film Co., and developed with a developer having the following composition at 27° C.

| Developer Composition | |
|---|---|
| Formaldehyde-sodium bisulfite adduct (1:1 molar) | 60 g |
| Hydroquinone | 17 g |
| Boric acid | 3 g |
| Potassium bromide | 3 g |
| Sodium sulfite | 3 g |
| Sodium carbonate | 65 g |
| Ethylene diamine tetraacetic acid tetrasodium salt | 1 g |
| Water to make | 1000 ml |

After processing, the tendency to form drag streaks was evaluated for each sample by calculating the average rate of increment or reduction of the dot area at the regions (shown by the ellipses (C) in FIG. 1) adjacent the downstream edges of areas A and B.

TABLE 1

| | Blending Ratio of Emulsions (mol% AgX) | | | | | | | |
|---|---|---|---|---|---|---|---|---|
| No. | Emulsion A | Emulsion B + 5-methyl-7-hydroxy-2,3,4-triazaindolidine As salt-1.5 g/mol AgX | Emulsion B + 1-phenyl-5-mercaptotetrazole Ag salt-1.0 g/mol AgX | Emulsion B | Emulsion C + 5-methyl-7-hydroxy-2,3,4-triazaindolidine Ag salt-1.5 g/mol AgX | Emulsion C + 1-phenyl-5-mercaptotetrazole As salt-1.0 g/mol AgX | Emulsion C | Drag* Streaks |
| 1 | 100 | | | | | | | −20%<br>+40 |
| 2 | 80 | 20 | | | | | | − 5<br>+ 5 |
| 3 | 60 | 40 | | | | | | − 0<br>+ 0 |
| 4 | 80 | | 20 | | | | | − 5<br>+ 5 |
| 5 | 80 | | | 20 | | | | −15<br>+15 |
| 6 | 80 | | | | 20 | | | − 5<br>+ 5 |
| 7 | 80 | | | | | 20 | | − 5<br>+ 5 |
| 8 | 80 | | | | | | 20 | −20<br>+20 |

*Increase or decrease of dot area in Ellipse C; adjacent area A (reduction), adjacent area B (increase).

The results shown in Table 1 establish that drag streaks were markedly reduced except for samples 1 (corresponding to Emulsion A alone) and 8 (Emulsion A + Emulsion C).

At the extreme right of the table are shown the reduction ratio in the dot area adjacent area A in the upper line and the increased ratio adjacent the area B in the lower line. The significance of this value is that the degree of drag streak formation is reduced as it is lowered.

EXAMPLE 2

The procedures used to prepare Emulsions B and C of Example 1 were repeated except that as the halide solution there was used 1000 ml of a 0.05 molar KI solution and 1000 ml of a 1.05 molar NaCl solution. The chemically sensitized emulsion was designated Emulsion D, and the emulsion not sensitized Emulsion E. The photographic speed of Emulsion D was controlled so as to be 1/10 that of Emulsion A. The speed of Emulsion E was less than 1/100 the speed of Emulsion A. After 5-methyl-7-hydroxy-2,3,4-triazaindolidine silver salt was added to each of Emulsions D and E in an amount of 1.5 g/mol AgCl, the emulsions were blended with Emulsion A in the ratios shown in Table 2. The resulting mixtures were coated onto a polyethylene terephthalate film and processed as in Example 1 and subjected to evaluation for drag streaks. The results are shown in Table 2.

TABLE 2

| No. | Blending Ratio of Emulsions (mol% AgX) Emulsion A | Emulsion D | Emulsion E | Drag Streaks* |
|---|---|---|---|---|
| 1 | 100 | | | −20%<br>+40 |
| 2 | 80 | 20 | | − 5<br>+ 5 |
| 3 | 60 | 40 | | − 5<br>+ 5 |
| 4 | 80 | | 20 | −10<br>+15 |
| 5 | 60 | | 40 | −10<br>+15 |

*Increase or decrease of dot area in the ellipses

The results in Table 2 show that blending Emulsions D and E, each including 5-methyl-7-hydroxy-2,3,4-triazaindolidine silver salt, is effective to reduce drag streaks. This is particularly the case for Emulsion D.

EXAMPLE 3

Photographic samples having the layer structures shown in Table 3 were produced using Emulsions A, B and C, to the latter two of which was added 5-methyl-7-hydroxy-2,3,4-triazaindolidine silver salt in an amount of 2.0 g/mol silver halide. Emulsion C without this complex was also used. Evaluation of drag streaks was carried out after the processing as in Example 1.

TABLE 3

| No. | Bottom layer; Coating rate of silver Emulsiion A | Top layer; Coating rate of silver Emulsion B | Emulsion C | Emulsion C | Drag* Streaks |
|---|---|---|---|---|---|
| | (g/m²) | + Complex 2.0g/mol AgX (g/m²) | + Complex 2.0g/mol AgX (g/m²) | (g/m²) | |
| 1 | 6 | | | | −20%<br>+40 |
| 2 | 5 | 1 | | | −5<br>+5 |
| 3 | 4 | 2 | | | 0<br>0 |
| 4 | 4 | | 2 | | 0<br>0 |
| 5 | 4 | | | 2 | −20<br>+20 |

After processing, the deviation of the dot area at regions (C) adjacent areas A and B was evaluated to judge the degree of drag streak formation.

Table 3 shows that drag streaks were noticeably reduced when Emulsion B or C, each containing 5-methyl-7-hydroxy-2,3,4-triazaindolidine silver salt, was coated contiguous to Emulsion A, in comparison to the standard Sample No. 1. The coating rate of silver in the table corresponds to the amount of silver contained in the emulsion coated per unit area, i.e., per 1 $M^2$.

While the invention has been described in detail and with reference to specific embodiments thereof, it will be apparent to one skilled in the art that various changes and modifications can be made therein without departing from the spirit and scope thereof.

What is claimed is:

1. A continuous method for producing halftone images comprising:

1. image-wise exposing a lith-type silver halide photographic material comprising a silver halide emulsion with not less than about 85 mol% silver chloride and not more than about 8 mol% silver iodide and containing at least one organic silver complex compound which is substantially insoluble in water and has a maximum solubility of not more than $10^{-4}$ mol per liter in contiguous relationship with a photosensitive silver chlorobromide or chlorobromoiodide emulsion which contains not less than 60 mol% silver chloride and which is chemically and spectrally sensitized, a photographic speed of the silver halide emulsion containing the silver complex compound being about 1/5 to about 1/100 that of the silver chlorobromide or chlorobromoiodide emulsion, and
2. developing said photographic material in a continuous fashion with a developer containing hydroquinone and a carbonyl bisulfite adduct in the presence of a polyalkylene oxide of a molecular weight not less than 1000.

2. The method of claim 1, wherein said organic silver complex compound has a smaller solubility product constant in water than that of silver chloride.

3. The method of claim 2, wherein said organic silver complex is selected from silver complex compounds having an imino or mercapto group.

4. The method of claim 3, wherein said organic silver complex compound is a silver complex of benzimidazole, 2-mercaptobenzothiazole, 2-mercaptobenzimidazole, 1-phenyl-5-mercaptotetrazole, 7-hydroxy-2,3,4-triazaindolidine, 5-methyl-7-hydroxy-2,3,4-triazaindolidine, or 5-butyl-7-hydroxy-2,3,4-triazaindolidine.

5. The method of claim 1, wherein said organic silver complex compound is added to at least one of the emulsions in an amount of from about 0.1 to about 10 g of the complex per mol of silver halide in the emulsion.

6. The method of claim 5 wherein said silver halide emulsion with not less than about 85 mol% silver chloride is present in an amount of from about 5 to 70 wt.% of said silver halide emulsion which contains not less than 60 mol% of silver chloride, based on 100 wt.% of the latter named emulsion.

* * * * *